United States Patent [19]

Watanabe et al.

[11] 4,275,328

[45] Jun. 23, 1981

[54] SPARK PLUG HAVING INTERMEDIATE ELECTRODE AND NON-PARALLEL SERIES GAPS

[75] Inventors: Toshio Watanabe, Oobu; Tadashi Hattori, Okazaki, both of Japan

[73] Assignee: Nippon Soken, Inc., Nishio, Japan

[21] Appl. No.: 15,437

[22] Filed: Feb. 26, 1979

[30] Foreign Application Priority Data

May 16, 1978 [JP] Japan ..... 53-58104

[51] Int. Cl.[3] ..... H01T 13/46

[52] U.S. Cl. ..... 313/123

[58] Field of Search ..... 313/123, 118 US, 124 US

[56] References Cited

U.S. PATENT DOCUMENTS

| | | | |
|---|---|---|---|
| 2,136,206 | 11/1938 | Dukelow | 313/123 |
| 2,226,711 | 12/1940 | Dukelow | 313/123 |
| 2,852,713 | 9/1958 | Gendron | 313/123 |
| 3,577,170 | 5/1971 | Nylen | 313/123 |

*Primary Examiner*—Robert Segal

*Attorney, Agent, or Firm*—Cushman, Darby & Cushman

[57] ABSTRACT

A spark plug for an internal combustion engine comprising an intermediate electrode in addition to a center electrode and a ground electrode for defining a first air gap between the intermediate electrode and the center electrode and a second air gap between the intermediate electrode and the ground electrode. The first and second air gaps extend in different directions, and spark discharge occurs simultaneously in these air gaps so that the air-fuel mixture flowing toward the spark plug from various directions can be ignited by the sparks jumping across the air gaps.

2 Claims, 14 Drawing Figures

SPARK PLUG HAVING INTERMEDIATE ELECTRODE AND NON-PARALLEL SERIES GAPS

BACKGROUND OF THE INVENTION

Field of the Invention

This invention relates to a spark plug for use in an internal combustion engine, for example, that used in an automobile engine.

DESCRIPTION OF THE PRIOR ART

Figure 1:
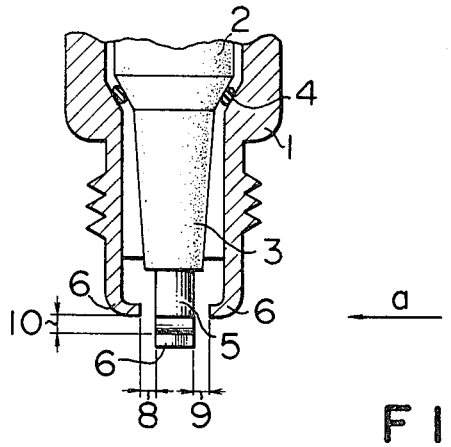
FIG. 1 PRIOR ART
FIG. 1 is a longitudinal sectional view of a prior art spark plug.
Figure 2:
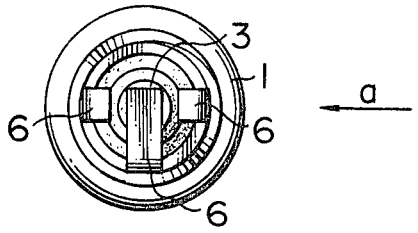
FIG. 2 PRIOR ART
FIG. 2 is a bottom plan view of the prior art spark plug shown in FIG. 1.

A known spark plug of the kind adapted for use in an internal combustion engine for an automobile has a structure as shown in FIGS. 1 and 2. Referring to FIGS. 1 and 2, the prior art spark plug comprises a generally cylindrical housing 1 of metal material, a generally columnar supporting member 2 of electrical insulator having a leg portion 3, an annular packing 4 of metal material, a center electrode 5 fixedly supported in the leg portion 3 of the supporting member 2, and ground electrodes 6 formed as a part of the housing 1. In the prior art structure shown in FIGS. 1 and 2, two of the three ground electrodes 6 have inwardly directed end portions whose end faces are disposed opposite to a side wall portion of the center electrode 5 to define air gaps 8 and 9 therebetween, and the remaining ground electrode 6 has a transversely extending end portion disposed opposite to the end face of the center electrode 5 to define another air gap 10 therebetween.

This prior art spark plug can satisfactorily ignite the air-fuel mixture by the spark jumping across the air gap 10 when the air-fuel mixture flows toward the spark plug from a direction as, for example, shown by the arrow a. However, occurrence of spark discharge in the air gap 10 among the air gaps 8, 9 and 10 is governed by the probability, and spark discharge may possibly occur in the air gap 8 or 9 instead of the air gap 10. The prior art spark plug is therefore defective in that it is not fit for satisfactory ignition of the air-fuel mixture which flows toward the spark plug from various directions and is thus impractical for the intended service.

SUMMARY OF THE INVENTION

It is a primary object of the present invention to provide an improved spark plug which obviates the prior art defect pointed out above.

It is another object of the present invention to provide a spark plug for an internal combustion engine comprising a center electrode, a ground electrode, and an intermediate electrode which define a first air gap between the intermediate electrode and the center electrode to extend in a first direction and a second air gap between the intermediate electrode and the ground electrode to extend in a second direction different from the first direction so that at least either of spark discharges simultaneously caused across the two gaps can deal with and ignite air-fuel mixture flowing from an optional direction toward the spark plug.

DETAILED DESCRIPTION OF THE INVENTION

Preferred embodiments of the present invention will now be described in detail with reference to the drawings, in which like reference numerals are used to denote like parts appearing in FIGS. 1 and 2.

Figure 3:
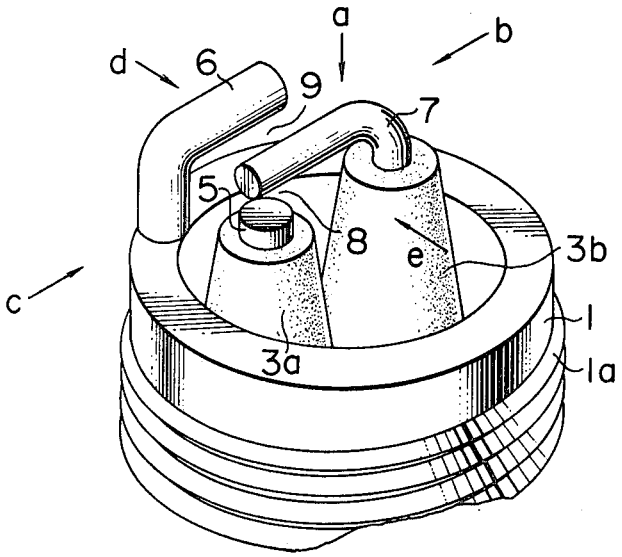
FIG. 3 is a perspective view of a first embodiment of the spark plug according to the present invention.
Figure 4:
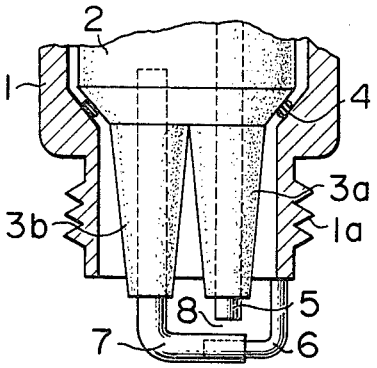
FIG. 4 is a longitudinal sectional view of the spark plug shown in FIG. 3.
Figure 5:
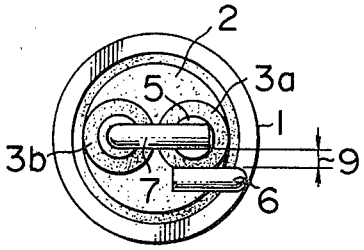
FIG. 5 is a bottom plan view of the spark plug shown in FIG. 4.

Referring first to FIGS. 3 to 5 showing a first embodiment of the spark plug according to the present invention, a generally cylindrical housing 1 of metal material is formed with an externally threaded wall portion 1*a* for threaded engagement with a corresponding portion of a cylinder head (not shown) of an internal combustion engine. A generally columnar supporting member 2 of electrical insulator has two leg portions 3*a* and 3*b* extending into an associated combustion chamber (not shown) of the internal combustion engine, and a central electrode 5 is fixedly supported in the leg portion 3*a* of the supporting member 2. This supporting member 2 is fixedly kept gas-tight within the housing 1 by means of an annular packing 4 of metal material. A ground electrode 6 bent into a J-like (or L-like) shape is fixed as by welding to the lower end face of the housing 1. An intermediate electrode 7 bent also into a J-like (or L-like) shape is fixed as by bonding in the other leg portion 3*b* of the supporting member 2. As shown in FIG. 4, it is isolated in the leg portion 3*b*. The transversely extending end portion of the generally J-shaped intermediate electrode 7 is disposed opposite to the end face of the center electrode 5 to define a first air gap 8 therebetween. The transversely extending end portion of the intermediate electrode 7 is disposed also opposite or in parallel to the transversely extending end portion of the generally J-shaped ground electrode 6 to define a second air gap 9 therebetween. These two air gaps 8 and 9 are connected in series with each other by the intermediate electrode 7 and yet extend in directions different from each other. That is, these two air gaps 8 and 9 do not align on the same straight line and are offset from each other. The center electrode 5 is electrically connected to a high voltage supply terminal (not shown). The air gaps 8 and 9 are dimensioned to lie within the range of 0.5 mm to 1.5 mm.

The operation of the spark plug having the aforementioned structure will now be described. When a high voltage is applied across the center electrode 5 and the ground electrode 6, an electric field is produced in each of the two air gaps 8 and 9 by the electrostatic induction, and due to the resultant dielectric breakdown, spark discharge occurs simultaneously in these two air gaps 8 and 9. The spark jumping across the second air gap 9 makes igniting contact with the stream of the air-fuel mixture flowing toward the spark gap from directions as shown by the arrows a, b, and c in FIG. 3, while the spark jumping across the first air gap 8 makes igniting contact with the stream of the air-fuel mixture flowing toward the spark plug from directions as shown by the arrows d and e in FIG. 3. Therefore, the air-fuel mixture flowing toward the spark gap can be satisfactorily ignited due to the fact that the air gaps 8 and 9 are located to deal with the various or optional flowing directions of the air-fuel mixture. The sparks can thus jump across these two air gaps 8 and 9 in a reliable manner regardless of the same or different dimensions of these air gaps 8 and 9.

Figure 6:
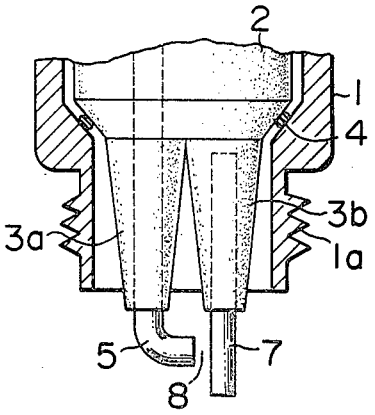
FIG. 6 is a longitudinal section view of a second embodiment of the spark plug according to the present invention.
Figure 7:
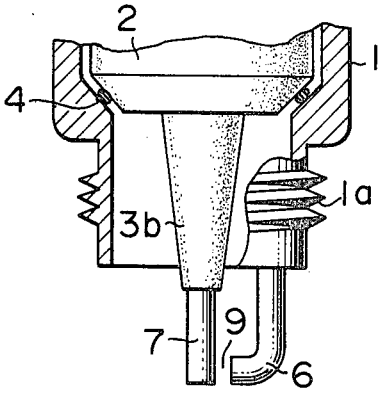
FIG. 7 is a view similar to FIG. 6 when looked from the right-hand side of FIG. 6.
Figure 8:
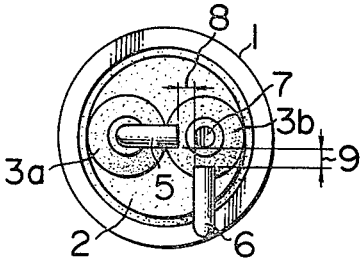
FIG. 8 is a bottom plan view of the spark plug shown in FIG. 6.

FIGS. 6 to 8 show a second embodiment of the present invention. In this embodiment, the center electrode 5 is bent into a J-like (or L-like) shape, and the intermediate electrode 7 is straight. The end faces of the transversely extending end portions of the generally J-shaped center electrode 5 and ground electrode 6 are disposed opposite to associated end-adjacent side portions of the straight intermediate electrode 7 to define the first and second air gaps 8 and 9 therebetween respectively.

Figure 9:
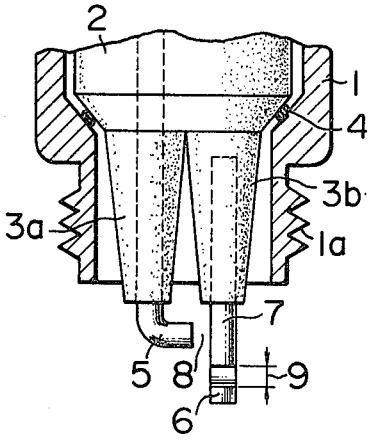
FIG. 9 is a longitudinal sectional view of a third embodiment of the spark plug according to the present invention.
Figure 10:
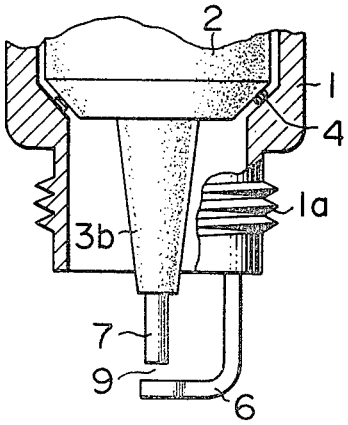
FIG. 10 is a view similar to FIG. 9 when looked from the right-hand side of FIG. 9.
Figure 11:
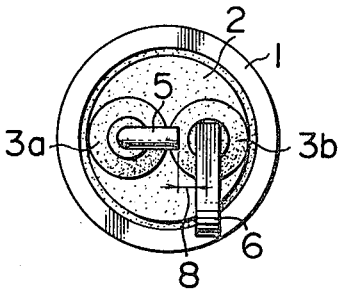
FIG. 11 is a bottom plan view of the spark plug shown in FIG. 9.

FIGS. 9 to 11 show a third embodiment of the present invention. In this embodiment, the end face of the transversely extending end portion of the generally J-shaped center electrode 5 is disposed opposite to an associated side portion of the intermediate electrode 7 to define the first air gap 8 therebetween, and the transversely extending end portion of the generally J-shaped ground electrode 6 is disposed opposite to the end face of the intermediate electrode 7 to define the second air gap 9 therebetween.

Figure 12:
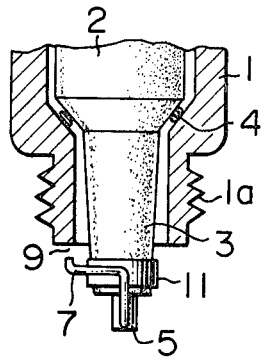
FIG. 12 is a longitudinal sectional view of a fourth embodiment of the spark plug according to the present invention.
Figure 13:
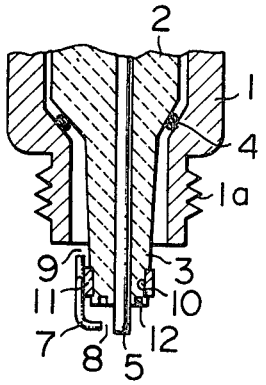
FIG. 13 is a view similar to FIG. 12 when looked from the right-hand side of FIG. 12.
Figure 14:
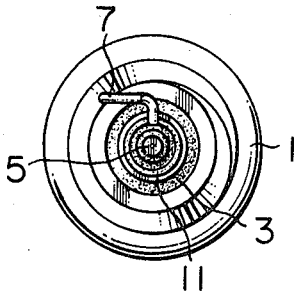
FIG. 14 is a bottom plan view of the spark plug shown in FIG. 13.

FIGS. 12 to 14 show a fourth embodiment of the spark plug according to the present invention. Referring to FIGS. 12 to 14, the spark plug comprises a generally cylindrical housing 1 of metal material formed with an externally threaded wall portion 1*a*, a generally columnar supporting member 2 of electrical insulator having a single leg portion 3, and an annular packing 4 of metal material. A central electrode 5 is fixedly supported in the leg portion 3 of the supporting member 2, and an annular groove 10 is formed adjacent to the projecting end of the leg portion 3 of the supporting member 2. An intermediate electrode 7 bent into a crank-like shape is fixed as by welding to a ring 11 of metal material, and this metal ring 11 is fitted in the annular groove 10 on the leg portion 3 of the supporting member 2. Another annular groove 12 is formed on the end face of the leg portion 3 of the supporting member 2 to act as a creeping-discharge preventive means so that a spark may not jump from the center electrode 5 toward the metal ring 11 along the wall face of the leg portion 3 of the supporting member 2. A first air gap 8 is defined between a side wall portion of the center electrode 5 and the associated end face of one end of the intermediate electrode 7, and a second air gap 9 is defined between the lower end face of the housing 1 and the end face of the other end of the intermediate electrode 7. In this fourth embodiment, the housing 1 serves as the ground electrode.

As mentioned above, the spark plugs of the present invention which have the center, intermediate and ground electrodes defining the first and second air gaps therebetween are designed to cause spark discharge simultaneously in the first and second air gaps which may have the same or different dimensions, when a high voltage is applied across the center electrode and the ground electrode. Due to the fact that the spark discharge occurs simultaneously in the first and second air gaps and that the directions of these two air gaps are different from each other in the above mentioned manner, either of the spark discharges caused across the air gaps can necessarily deal with and ignite the stream of the air-fuel mixture flowing toward the spark plug from various directions so that the air-fuel mixture can be satisfactorily ignited regardless of its flowing direction.

We claim:

1. A spark plug for an internal combustion engine comprising a center electrode, a ground electrode, an intermediate electrode disposed between said center electrode and said ground electrode, a first air gap defined between said intermediate electrode and said center electrode to extend in a first direction, and a second air gap defined between said intermediate electrode and said ground electrode to extend in a second direction different from said first direction, whereby when a high voltage is applied across said center electrode and said ground electrode, spark discharge occurs simultaneously in said first and second air gaps;

further comprising a supporting member of electrical insulator having a pair of leg portions partly protruding from a housing of metal material for fixedly supporting said center electrode in one of said leg portions, said ground electrode being bent into a J-like shape and fixed at one end to the end face of said housing, said intermediate electrode being also bent into a J-like shape and fixedly supported and isolated in the other of said leg portions of said supporting member, the end face of said center electrode being disposed opposite to an end-adjacent side portion of said J-shaped intermediate electrode to define said first air gap therebetween, and and end-adjacent side portion of said J-shaped ground electrode being disposed opposite to another end-adjacent side portion of said J-shaped intermediate electrode to define said second air gap therebetween;

said ground electrode and intermediate electrode being rod-shaped.

2. A spark plug as claimed in claim 1, wherein said first and second air gaps have the same or different dimensions lying within the range of 0.5 mm to 1.5 mm.

* * * * *